US007922163B2

(12) United States Patent
Ichihashi et al.

(10) Patent No.: US 7,922,163 B2
(45) Date of Patent: Apr. 12, 2011

(54) SHEET PROCESSING DEVICE AND IMAGE FORMING APPARATUS

(75) Inventors: Ichiro Ichihashi, Aichi (JP); Masahiro Tamura, Kanagawa (JP); Nobuyoshi Suzuki, Tokyo (JP); Shuuya Nagasako, Kanagawa (JP); Naohiro Kikkawa, Kanagawa (JP); Kazuhiro Kobayashi, Kanagawa (JP); Tomohiro Furuhashi, Kanagawa (JP); Makoto Hidaka, Tokyo (JP); Hitoshi Hattori, Tokyo (JP); Junichi Tokita, Kanagawa (JP); Akira Kunieda, Tokyo (JP); Hiroshi Maeda, Aichi (JP); Tomoichi Nomura, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 356 days.

(21) Appl. No.: 12/230,733

(22) Filed: Sep. 4, 2008

(65) Prior Publication Data

US 2009/0066001 A1 Mar. 12, 2009

(30) Foreign Application Priority Data

Sep. 4, 2007 (JP) ..... 2007-229054

(51) Int. Cl.
*B65H 37/04* (2006.01)

(52) U.S. Cl. ..... 270/58.12; 270/58.07; 270/58.08; 270/58.11; 270/58.17; 270/58.27

(58) Field of Classification Search ..... 270/58.07, 270/58.08, 58.11, 58.12, 58.17, 58.27
See application file for complete search history.

(56) References Cited

U.S. PATENT DOCUMENTS

| | | | | |
|---|---|---|---|---|
| 5,709,376 | A * | 1/1998 | Ushirogata | 270/58.11 |
| 6,145,825 | A * | 11/2000 | Kunihiro et al. | 270/58.09 |
| 6,799,759 | B1 * | 10/2004 | McNamara et al. | 270/58.08 |
| 2006/0261544 | A1 | 11/2006 | Tamura et al. | |
| 2006/0279037 | A1 * | 12/2006 | Kushida et al. | 270/58.08 |
| 2007/0235917 | A1 | 10/2007 | Nagasako et al. | |
| 2008/0006993 | A1 | 1/2008 | Nomura et al. | |
| 2008/0048380 | A1 | 2/2008 | Ichihashi et al. | |
| 2008/0067730 | A1 | 3/2008 | Suzuki et al. | |

FOREIGN PATENT DOCUMENTS

JP 2008-019028 1/2008

OTHER PUBLICATIONS

Abstract of JP 11-130338 published May 18, 1999.

* cited by examiner

*Primary Examiner* — Leslie A Nicholson, III
(74) *Attorney, Agent, or Firm* — Harness, Dickey & Pierce, P.L.C.

(57) ABSTRACT

A pressing unit presses vicinity of a trailing edge of a stack of sheets stacked in a tray. An aligning unit aligns the stack of sheets stacked in the tray. A stapling unit binds the stack of sheets aligned by the aligning unit. A discharging unit discharges the stack of sheets bound by the stapling unit. A control unit controls the pressing unit to keep a constant distance from a surface of a top sheet of the stack of sheets when the discharging unit discharging the stack of sheets.

8 Claims, 9 Drawing Sheets

SHEET PROCESSING DEVICE AND IMAGE FORMING APPARATUS

CROSS-REFERENCE TO RELATED APPLICATIONS

The present application claims priority to and incorporates by reference the entire contents of Japanese priority document 2007-229054 filed in Japan on Sep. 4, 2007.

BACKGROUND OF THE INVENTION

1. Field of the Invention

The present invention relates to a sheet processing device that performs a predetermined process on a conveyed sheet and an image forming apparatus including the sheet processing device integrally or separately.

2. Description of the Related Art

A sheet processing device capable of performing a finishing process on a sheet has been come into wide use in recent years. Specifically, the sheet processing device can perform various finishing processes, such as a punching process, an aligning process, a stapling process, a folding process, and a binding process, on a sheet conveyed from an image forming apparatus, i.e., a sheet on which an image is formed by the image forming apparatus. Incidentally, the sheet processing device can be built into the image forming apparatus, or provided separately from the image forming apparatus as an external device. However, the conventional sheet processing device has such a problem that when a stack of sheets to be stapled is discharged from a staple tray, a buckling distortion or a bending deformation may occur in the stack of sheets depending on a type and a size of the sheets, or a use environment. If a degree of the buckling distortion or the bending deformation is large, the stack of sheets may come in contact with a brush roller (a return roller) arranged on the upstream of the staple tray, and thereby causing a sheet jam. To avoid such a situation, in conventional technologies, a pressing unit is provided in the sheet processing device. The pressing unit presses on near a trailing end portion of the stack of sheets thereby aligning the sheets and also moving the stack of sheets not to come in contact with the brush roller.

A sheet processing device including such a pressing unit is disclosed in, for example, Japanese Patent No. 3748710. The sheet processing device disclosed in Japanese Patent No. 3748710 includes a staple tray, a trailing-end fence, a stapling unit, and the pressing unit. A sheet discharged from an image forming apparatus is stacked in the staple tray. An end of the sheet stacked in the staple tray in a sheet conveying direction is struck on the trailing-end fence thereby being aligned. The stapling unit staples a stack of sheets aligned by the trailing-end fence. The pressing unit is configured to be movable in a thickness direction of the stack of sheets stacked in the staple tray so as to change a distance between the pressing unit and a sheet-stacked surface of the staple tray. The stack of sheets is guided to the trailing-end fence while being pressed by the pressing unit.

However, in some of the conventional technologies, the pressing unit is fixed, i.e., the distance between the pressing unit and the sheet-stacked surface of the staple tray is kept constant regardless of the number of sheets staked on the staple tray. Therefore, it is possible to prevent the stack of sheets from having contact with the brush roller. However, it is not possible to reduce an occurrence of a buckling distortion or a bending deformation in the stack of sheets when the number of sheets is few. In this case, the stack of sheets passes by the pressing unit in a state where the sheets are still buckled or bent. To solve the problem, in the sheet processing device disclosed in Japanese Patent No. 3748710, the pressing unit is configured to be movable. However, the pressing unit does not move in consideration of a distance between a top-sheet face of the stack of sheets and the pressing unit, so that there is still a possibility of an occurrence of a buckling distortion or a bending deformation.

With an increase in processing speed of an image forming apparatus in recent years, there has been expected to provide a sheet processing device capable of processing at high speed. Therefore, it is necessary to improve the sheet processing device in such a manner that the stack of sheets is prevented from occurring a buckling distortion or a bending deformation and a wasted motion of the sheet processing device is reduced as much as possible to improve the productivity.

SUMMARY OF THE INVENTION

It is an object of the present invention to at least partially solve the problems in the conventional technology.

According to an aspect of the present invention, there is provided a sheet processing device including a tray in which a conveyed sheet is stacked; a pressing unit that presses vicinity of a trailing edge of a stack of sheets stacked in the tray; an aligning unit that aligns the stack of sheets stacked in the tray; a stapling unit that binds the stack of sheets aligned by the aligning unit; a discharging unit that discharges the stack of sheets bound by the stapling unit; and a control unit that controls the pressing unit to keep a constant distance from a surface of a top sheet of the stack of sheets when the discharging unit discharging the stack of sheets.

Furthermore, according to another aspect of the present invention, there is provided an image-forming apparatus including a sheet processing device. The sheet processing device includes a tray in which a conveyed sheet is stacked; a pressing unit that presses vicinity of a trailing edge of a stack of sheets stacked in the tray; an aligning unit that aligns the stack of sheets stacked in the tray; a stapling unit that binds the stack of sheets aligned by the aligning unit; a discharging unit that discharges the stack of sheets bound by the stapling unit; and a control unit that controls the pressing unit to keep a constant distance from a surface of a top sheet of the stack of sheets when the discharging unit discharging the stack of sheets.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
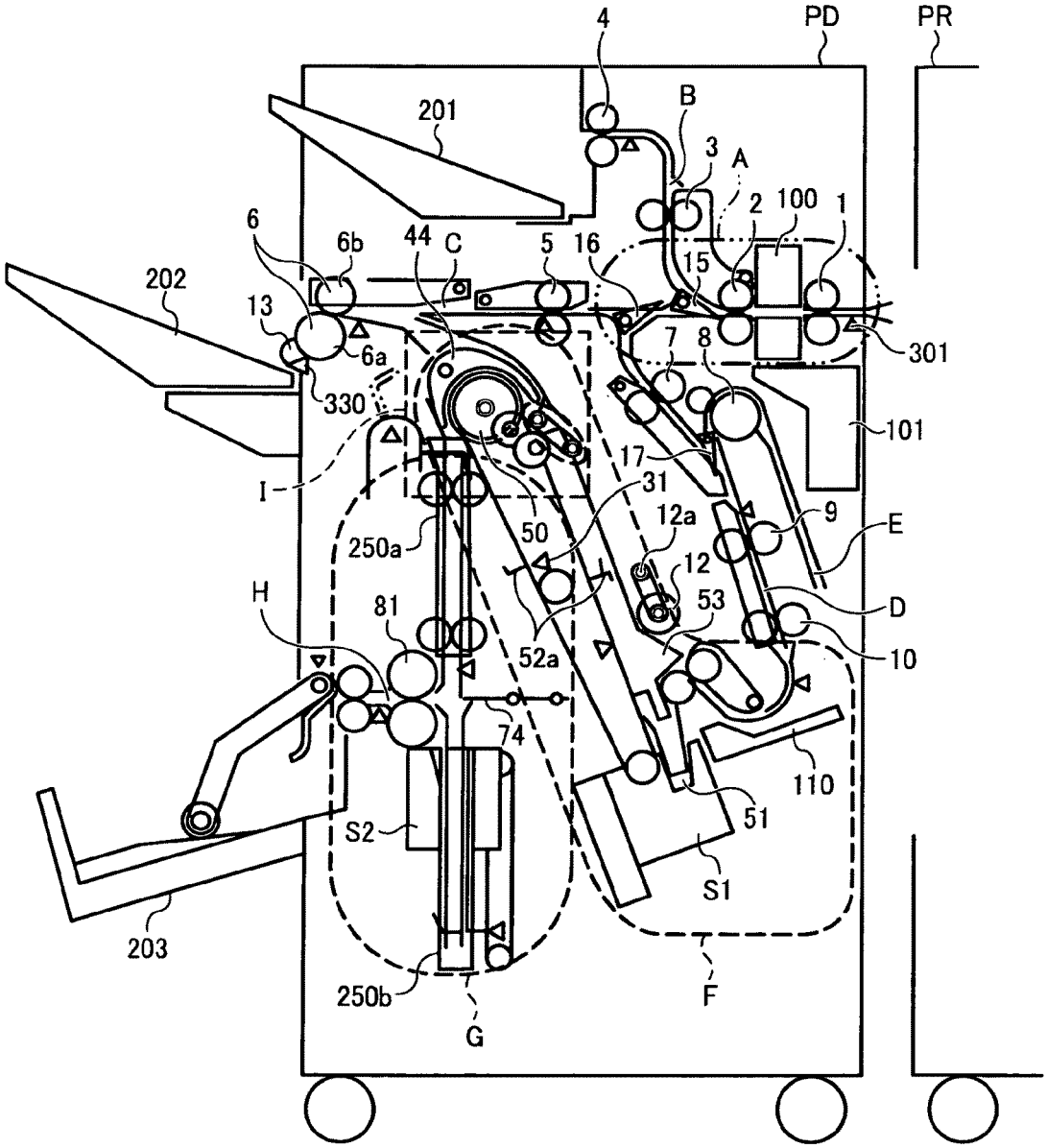
FIG. 1 is a system configuration diagram of a system composed of a sheet post-processing apparatus according to an embodiment of the present invention and an image forming apparatus.

FIG. 1 is a system configuration diagram of a system composed of a sheet post-processing apparatus PD according to an embodiment of the present invention and an image forming apparatus PR.

The sheet post-processing apparatus PD is attached to a side surface of the image forming apparatus PR. A sheet discharged from the image forming apparatus PR is guided to the sheet post-processing apparatus PD. The sheet is conveyed through any of conveying paths A, B, C, and D selectively by branch claws 15 and 16. The conveying path A includes a post-processing unit that performs post-processing on sheets one by one (in this embodiment, a punch unit 100 as a punching unit). The conveying path B is used to guide a sheet passing through the conveying path A to an upper tray 201. The conveying path C is used to guide a sheet passing through the conveying path A to a shift tray 202. The conveying path D is used to guide a sheet passing through the conveying path A to a processing tray F where the sheet is, for example, aligned and staple-bound.

Although the image forming apparatus PR is not fully illustrated in the drawing, the image forming apparatus PR includes at least an image processing circuit, an optical writing device, a developing unit, a transfer unit, and a fixing unit. The image processing circuit converts received image data into printable image data. The optical writing device performs optical writing on a photosensitive element based on an image signal output from the image processing circuit. The developing unit develops a latent image formed on the photosensitive element by the optical writing into a toner image. The transfer unit transfers the toner image onto a sheet. The fixing unit fixes the toner image transferred onto the sheet thereon. The image forming apparatus PR discharges the sheet on which the image is formed to the sheet post-processing apparatus PD. The sheet post-processing apparatus PD performs desired post-processing on the sheet. In the present embodiment, an electrophotographic image forming apparatus is employed as the image forming apparatus PR. Alternatively, any other types of commonly-used image forming apparatuses, such as an ink-jet image forming apparatus or a thermal-transfer type image forming apparatus, can be used as the image forming apparatus PR. Incidentally, in the present example, an image forming unit is composed of the image processing circuit, the optical writing device, the developing unit, the transfer unit, and the fixing unit.

When the sheet is conveyed to the staple tray F (hereinafter, "a staple tray F") through the conveying paths A and D, the sheet is, for example, aligned and stapled in the staple tray F. After that, the sheet is guided by a guide member 44 so as to be conveyed to any of the conveying path C or a saddle-stitch/center-folding processing tray G (hereinafter, just "a saddle-stitch processing tray G") where the sheet is, for example, folded. After the sheet is folded in the saddle-stitch processing tray G, the sheet is guided to a lower tray 203 through a conveying path H. A branch claw 17 is provided on the conveying path D. The branch claw 17 is maintained in a state shown in FIG. 1 by a low-load spring (not shown). After the sheet is conveyed by a pair of conveying rollers 7 and a trailing end of the sheet passes by the branch claw 17, out of pairs of conveying rollers 9 and 10 and a pair of staple discharge rollers 11 (a brush roller), at least the conveying rollers 9 are rotated in a reverse direction, so that the sheet is conveyed backward along a turn guide 8. As a result, the sheet is guided to a sheet containing unit E to enter thereto from the trailing end of the sheet, and retained (pre-stacked) on the sheet containing unit E. A subsequently-conveyed sheet is stacked on top of the sheet in a superimposed manner so as to be conveyed all together. By the repetition of this operation, it is possible to convey more than two sheets all together.

The conveying path A is located on the upstream of the conveying paths B, C, and D, and is a common pathway connecting to each of the conveying paths B, C, and D. Along the conveying path A, an inlet sensor 301, a pair of inlet rollers 1, the punch unit 100, a chad hopper 101, a pair of conveying rollers 2, the branch claws 15 and 16 are arranged in this order from an inlet. The branch claws 15 and 16 are maintained in a state shown in FIG. 1 by a spring (not shown). When each of solenoids (not shown) for driving the branch claws 15 and 16 respectively is turned on, the solenoid drives the corresponding branch claw to rotate so as to guide the sheet to any of the conveying paths B, C, and D.

When the sheet is to be guided to the conveying path B, the solenoids are turned off, i.e., the branch claws 15 and 16 are in the state shown in FIG. 1. When the sheet is to be guided to the conveying path C in the state shown in FIG. 1, the solenoids are turned on, whereby the branch claw 15 is driven to rotate upward and the branch claw 16 is driven to rotate downward. As a result, the sheet is discharged onto the upper tray 201 by passing through between a pair of conveying rollers 3 and a pair of discharge rollers 4. When the sheet is to be guided to the conveying path D in the state shown in FIG. 1, i.e., both the solenoids are turned off, the solenoid for the branch claw 15 is turned on when the branch claw 15 is in the state shown in FIG. 1, whereby the branch claw 15 is driven to rotate upward. As a result, the sheet is conveyed toward the shift tray 202 by passing through between a pair of conveying rollers 5 and a pair of shift discharge rollers 6 (6*a* and 6*b*).

The sheet post-processing apparatus PD can perform punching (by the punch unit 100), sheet alignment and edge binding (by jogger fences 53, 54, and 55 and an edge binding stapler S1), sheet alignment and saddle-stitch binding (by a saddle-stitch upper jogger fence 250*a*, a saddle-stitch lower jogger fence 250*b*, and a saddle-stitch binding stapler S2), sheet sorting (by the shift tray 202), center-folding (by a folding plate 74 and a pair of folding rollers 81), and the like.

As shown in FIG. 1, a shift-tray discharge unit located on the most downstream of the sheet post-processing apparatus PD includes the shift discharge rollers 6 (6*a* and 6*b*), a return roller 13, a sheet-face detecting sensor 330, the shift tray 202, a shift mechanism, and a shift-tray lifting mechanism. The shift mechanism causes the shift tray 202 to move in a reciprocating manner in a direction perpendicular to a sheet conveying direction. The shift-tray lifting mechanism lifts the shift tray 202 up and down.

The return roller 13 is made of sponge. The return roller 13 serves to align a sheet discharged from the shift discharge rollers 6 in such a manner that the return roller 13 has contact with the sheet and strikes a trailing end of the sheet on an end fence. The return roller 13 rotates in accordance with rotation of the shift discharge rollers 6. A tray lift-up limiting switch 333 is provided near the return roller 13. When the shift tray 202 is lifted up, the return roller 13 is pressed up, so that the tray lift-up limiting switch is turned on, and a tray lifting motor is stopped. Therefore, it is possible to prevent the shift tray 202 from overrunning. Furthermore, as shown in FIG. 1, the sheet-face detecting sensor 330 is arranged near the return roller 13. The sheet-face detecting sensor 330 detects a position of a sheet face of a sheet or a stack of sheets to be discharged onto the shift tray 202. When the sheet-face detecting sensor 330 detects that a height of the stack of sheets stacked in the shift tray 202 reaches a predetermined value, the shift tray 202 is lifted down for a predetermined distance by the use of a drive force from the tray lifting motor. Therefore, a position of a top-sheet face of the stack of sheets stacked in the shift tray 202 is kept substantially constant.

The shift discharge rollers 6 are composed of the shift discharge drive roller 6*a* and the shift discharge driven roller 6*b*. The shift discharge driven roller 6*b* is rotatably supported by a free end of an openable guide plate 33. One end of the openable guide plate 33 on the upstream side in the sheet discharging direction is supported, and the other end can rotate up and down. The shift discharge driven roller 6*b* has contact with the shift discharge drive roller 6*a* by the use of its own weight or a bias force, so that the sheet is discharged while being sandwiched between the shift discharge drive roller 6*a* and the shift discharge driven roller 6*b*. When the bound stack of sheets is discharged, the openable guide plate is rotated upward. At a predetermined timing, the openable guide plate is rotated back. The timing is determined based on a detection signal from the sheet-face detecting sensor 330. A stop position of the openable guide plate is determined based on a detection signal from a discharge guide-plate open/close sensor (not shown). The openable guide plate is driven to rotate by a discharge guide-plate open/close motor (not shown).

Figure 2:
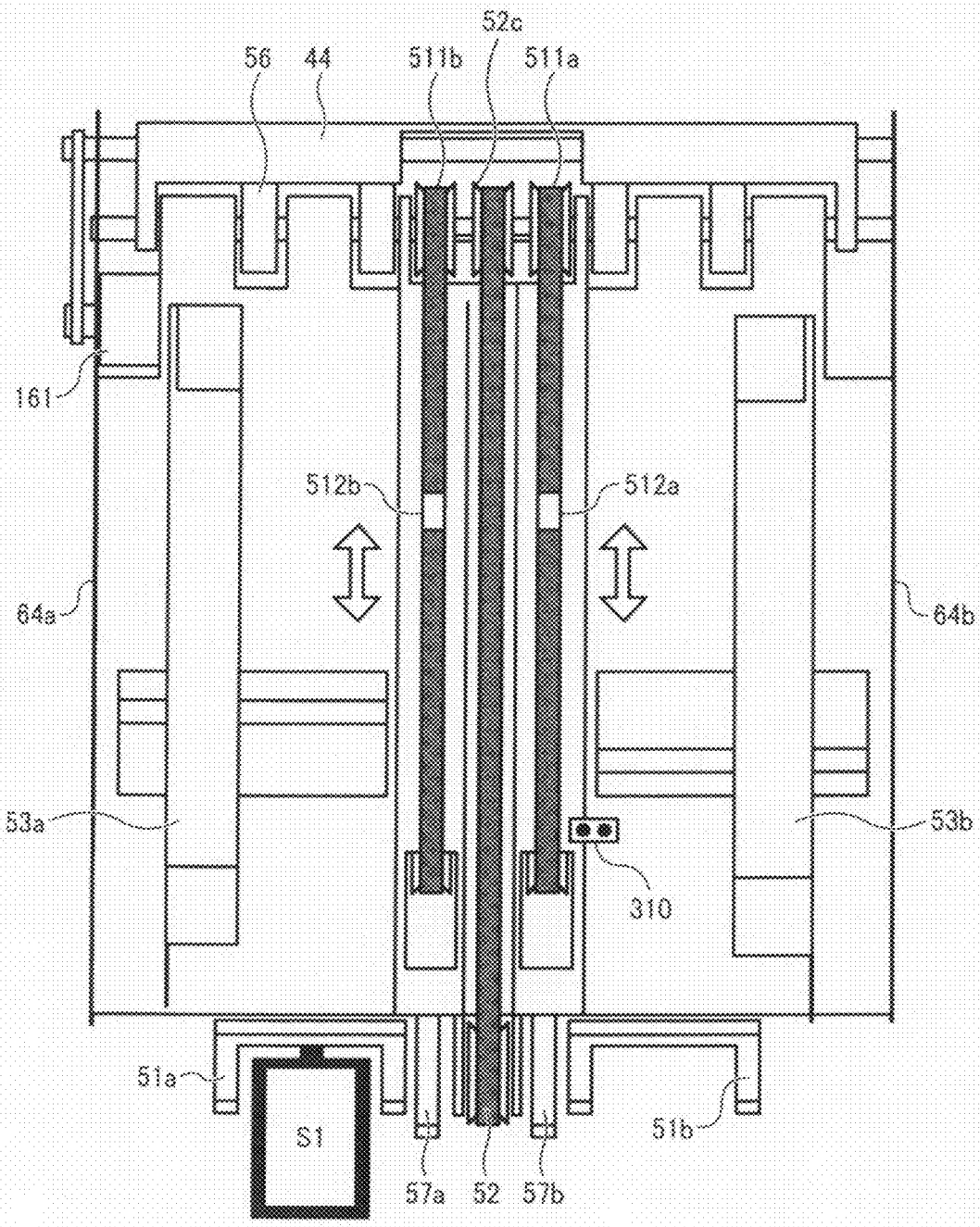
FIG. 2 is a front elevational view of a staple tray viewed from a sheet-stacked surface of the staple tray.
Figure 3:
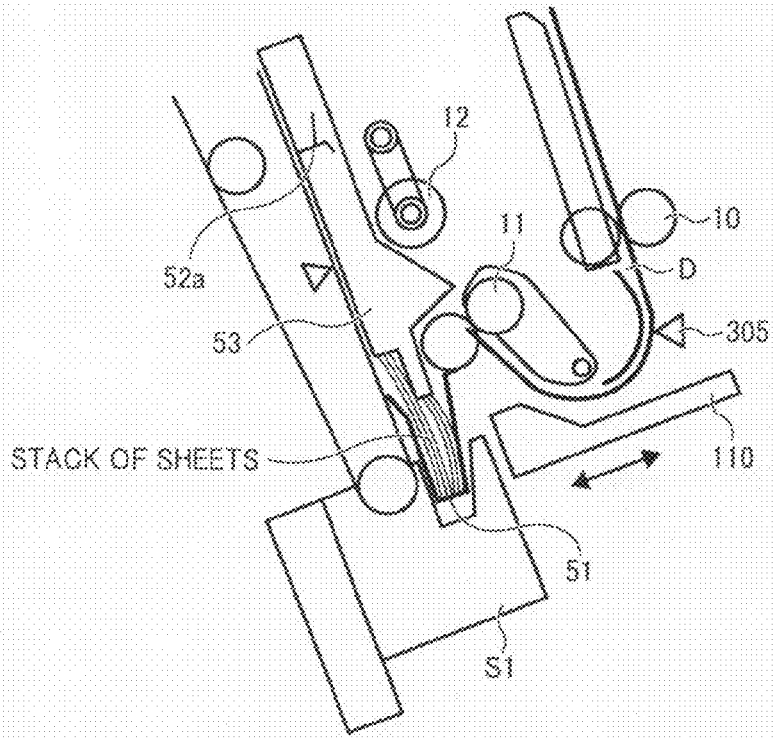
FIG. 3 is an enlarged view of a lower portion of the staple tray shown in FIG. 1 for explaining a sheet pressing mechanism.

A configuration of the staple tray F in which sheets are stapled is explained below with reference to FIGS. 2 and 3. FIG. 2 is a front elevational view of the staple tray F viewed from a sheet-stacked surface of the staple tray F. FIG. 3 is an enlarged view of a lower portion of the staple tray F.

A sheet guided into the staple tray F by the staple discharge rollers 11 is sequentially stacked on top of previously-stacked sheets on the sheet-stacked surface of the staple tray F. In this case, each time a sheet is stacked on top of the other on the sheet-stacked surface of the staple tray F, the sheet is returned in a longitudinal direction (the sheet conveying direction) by a return roller 12, and struck on trailing-end fences 51*a* and 51*b* by leading-end stoppers 512*a* and 512*b*, and then aligned in a lateral direction (a direction perpendicular to the sheet conveying direction, i.e., a sheet width direction) by the jogger fence 53. At an interval between jobs, i.e., an interval between when a last sheet of a stack of sheets is conveyed and when a first sheet of a subsequent stack of sheets is conveyed, the edge-binding stapler S1 is activated upon receiving a stapling signal from a control unit, and the stack of sheets is bound by the edge-binding stapler S1. The bound stack of sheets is lifted up by movable fences 57*a* and 57*b*. Incidentally, a sheet-stack receiving portion of each of the movable fences 57*a* and 57*b* is located slightly below a sheet-stack receiving portion of each of the trailing-end fences 51*a* and 51*b* so as to prevent the movable fences 57*a* and 57*b* from interfering with the leading-end stoppers 512*a* and 512*b* when the leading-end stoppers 512*a* and 512*b* perform the longitudinal alignment by striking the stack of sheets on the trailing-end fences 51*a* and 51*b*. After the stack of sheets is lifted up by the movable fences 57*a* and 57*b*, a discharge belt 52 is driven to rotate counterclockwise. The stack of sheets is picked up by a discharge claw 52*a*, and conveyed toward the discharge rollers 6. In this manner, the stack of sheets is discharged from the staple tray F. Incidentally, such an operation is also performed on a non-bound stack of sheets, i.e., a stack of sheet that is not to be bound after the alignment.

A home position of the discharge claw 52*a* is detected by a discharge-belt HP sensor 311. The discharge-belt HP sensor 311 is turned on/off by the discharge claw 52*a*. Actually, two numbers of the discharge claws 52*a* are provided on an outer circumference of the discharge belt 52 to be opposed to each other. The discharge claws 52*a* alternately convey a stack of sheets contained in the staple tray F.

As shown in FIG. 2, the discharge belt 52 is located at the alignment center in the sheet width direction. The discharge belt 52 is supported by a drive pulley and a driven pulley. A plurality of discharge rollers 56 are symmetrically arranged across the discharge belt 52. The discharge rollers 56 are rotatably supported by a drive shaft 52*b* thereby serving as driven rollers. Incidentally, reference numerals 64*a* and 64*b* respectively denote a front side plate and a back side plate, reference numerals 51*a* and 51*b* respectively denote a front-side trailing-end fence and a back-side trailing-end fence (indicated by a reference numeral 51 in FIG. 1).

The return roller 12 is caused to swing like a pendulum around a supporting point 12*a* by a tap solenoid 170, whereby a trailing end of a sheet conveyed to the staple tray F is struck on the jogger fence 53 intermittently. Incidentally, the return roller 12 rotates counterclockwise. As shown in FIG. 3, the jogger fence 53 includes a front-side jogger fence 53*a* and a back-side jogger fence 53*b*. The front-side jogger fence 53*a* and the back-side jogger fence 53*b* are driven to move in a reciprocating manner in the sheet width direction by a jogger motor (not shown) via a timing belt. The jogger motor can rotate in any of forward and reverse directions.

The edge binding stapler S1 is driven to move in the sheet width direction by a stapler travel motor via a timing belt so that the edge binding stapler S1 can bind an edge portion of sheets at a predetermined position. The stapler travel motor can rotate in any of forward and reverse directions.

Subsequently, a mechanism for pressing an uplift of a trailing end portion of a stack of sheets is explained below with reference to FIGS. 3 to 7. The mechanism presses a trailing end portion of a stack of sheets stacked in the staple tray F to prevent an uplift behavior of the trailing end portion.

The sheets discharged onto the edge-binding processing tray F are aligned in the longitudinal direction (the sheet conveying direction) by the return roller 12, as described above. At this time, a trailing end of any of the sheets may be curled up, or if the sheets are soft, a trailing end of each of the sheets tends to buckle by its own weight. Furthermore, as the number of stacked sheets increases, a space of a trailing-end fence 51 for a subsequently-stacked sheet is getting decreased. Therefore, it becomes difficult to align sheets in the longitudinal direction gradually. To solve the problems, the mechanism is provided to prevent an uplift behavior of a trailing end portion of the sheets and thereby making it easy for a subsequently-stacked sheet to be put into the trailing-end fence 51. FIG. 3 is a front view of the mechanism. The trailing-end fence 51 presses a trailing end portion of a stack of sheets SB contained therein. A trailing-end-portion pressing lever 110 is respectively arranged in the front side, the center, and the back side of the apparatus and is arranged near a bottom portion of the trailing-end fence 51, and moves in a reciprocating manner in a direction nearly perpendicular to the staple tray F.

Figure 4:
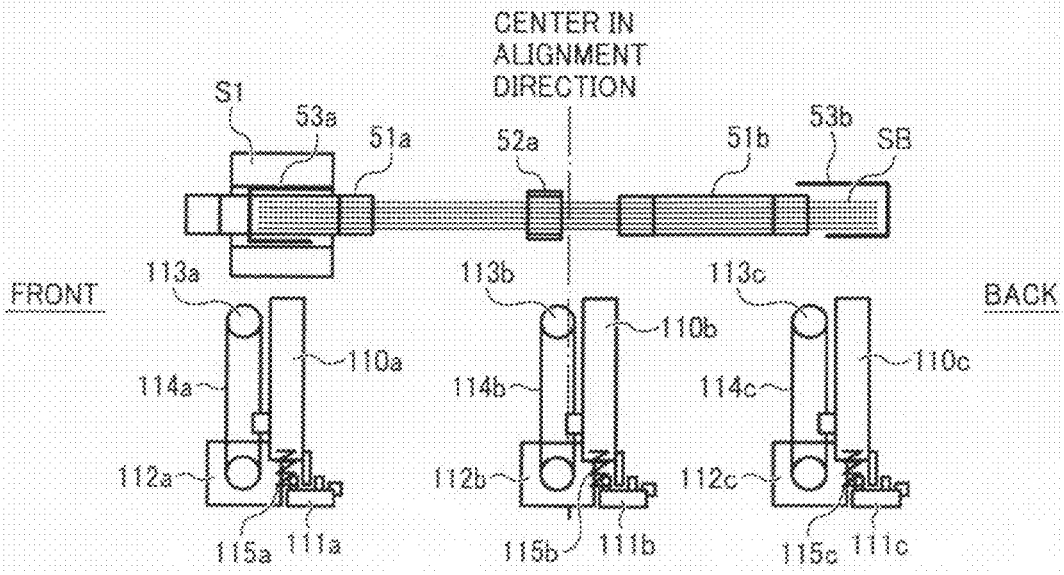
FIG. 4 is a schematic diagram of the sheet pressing mechanism of the staple tray viewed from the sheet-stacked surface.

As shown in FIG. 4, the trailing-end-portion pressing lever 110 includes three trailing-end-portion pressing levers 110*a*, 110*b*, and 110*c* that are respectively arranged in the front side, the center, and the back side of the apparatus. A mechanism of the trailing-end-portion pressing lever 110*a* located in the front side of the apparatus is explained below. The trailing-end-portion pressing lever 110*a* is fixed to a timing belt 114*a*. The timing belt 114*a* is connected to a trailing-end-portion pressing lever motor 112*a* via a pulley 113*a*, so that the timing belt 114 moves in accordance with rotation of the trailing-end-portion pressing lever motor 112*a*. When a home sensor 111*a* is shielded by a convex shielding portion 110*a*' (see FIG. 5) formed on the trailing-end-portion pressing lever 110*a*, the home sensor 111*a* detects a home position of the trailing-end-portion pressing lever 110*a*. The home position of the trailing-end-portion pressing lever 110*a* is set up at a position where the trailing-end-portion pressing lever 110*a* does not interfere with the edge binding stapler S1 even when the edge binding stapler S1 moves in a direction of an arrow in the sheet width direction to bind an edge portion of sheets. A travel distance of the trailing-end-portion pressing lever 110*a* in a direction of pressing a trailing end portion of a stack of sheets, i.e., a direction of an arrow shown in FIG. 3 is determined depending on the number of pulses input to the trailing-end-portion pressing lever motor 112*a*. The trailing-end-portion pressing lever 110*a* moves to a position where a tip of the trailing-end-portion pressing lever 110*a* presses an uplift of the trailing end portion of the stack of sheets while being in contact with the stack of sheets SB. A change in a thickness of the stack of sheets SB is absorbed by a stretching movement of a spring 115*a*. The trailing-end-portion pressing levers 110*b* and 110*c* have the same mechanism as the trailing-end-portion pressing lever 110*a*, so that description is omitted.

Figure 5:
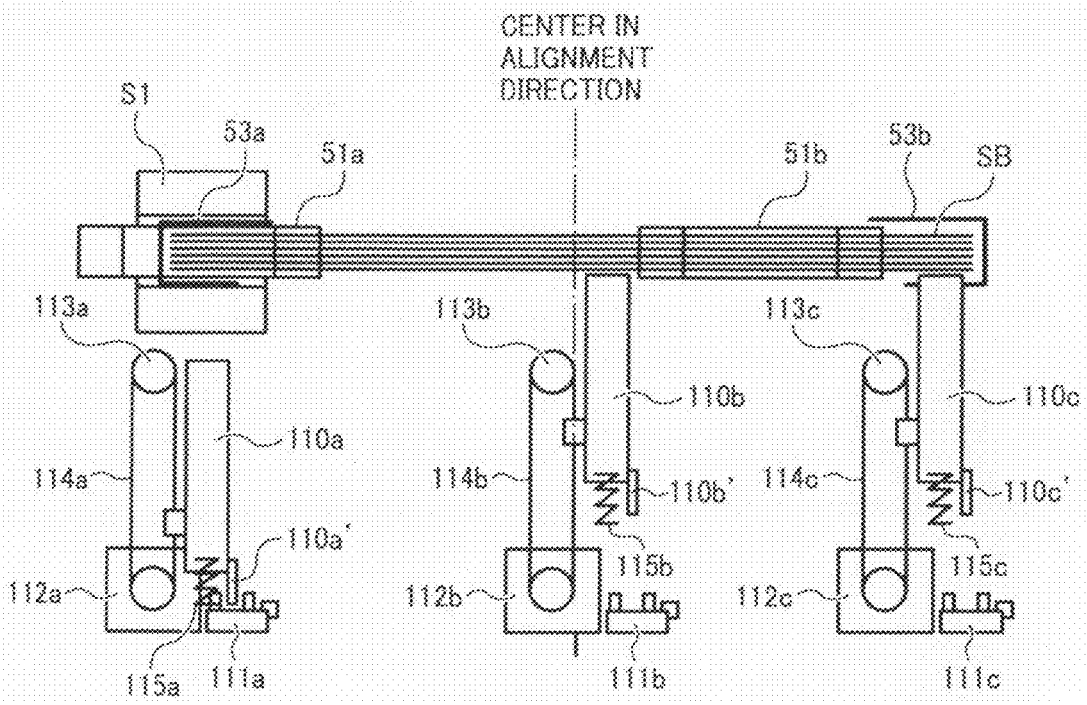
FIG. 5 is a schematic diagram of the sheet pressing mechanism of the staple tray viewed from the sheet-stacked surface for explaining a stand-by position of a stapler in a front-side binding mode.
Figure 6:
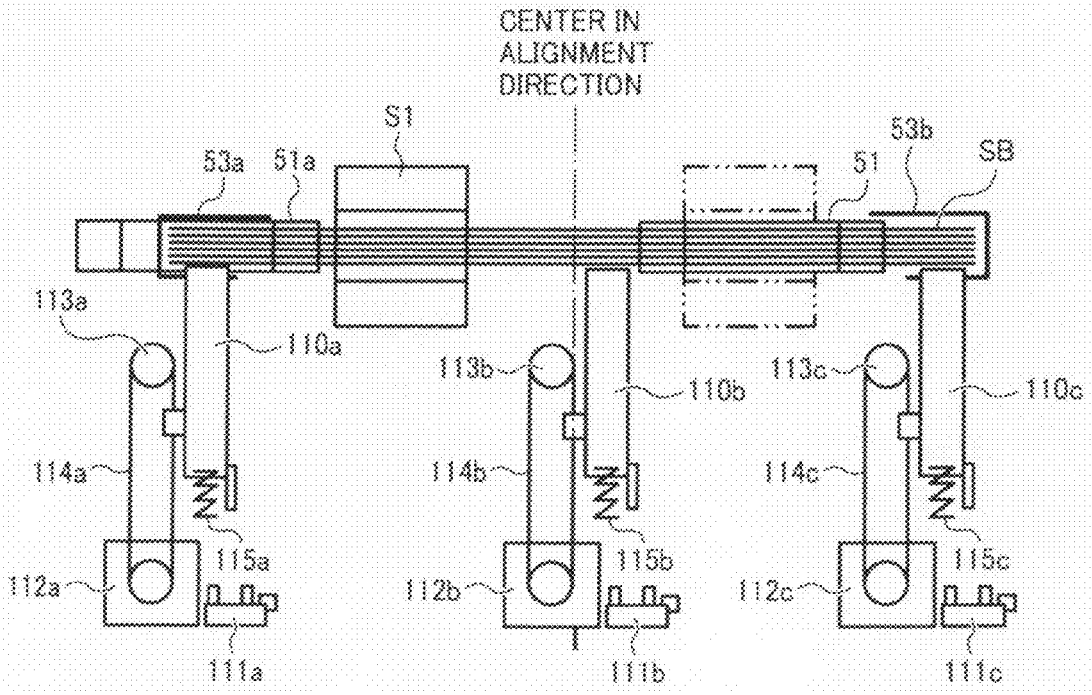
FIG. 6 is a schematic diagram of the sheet pressing mechanism of the staple tray viewed from the sheet-stacked surface for explaining a stand-by position of the stapler in a two-point binding mode.
Figure 7:
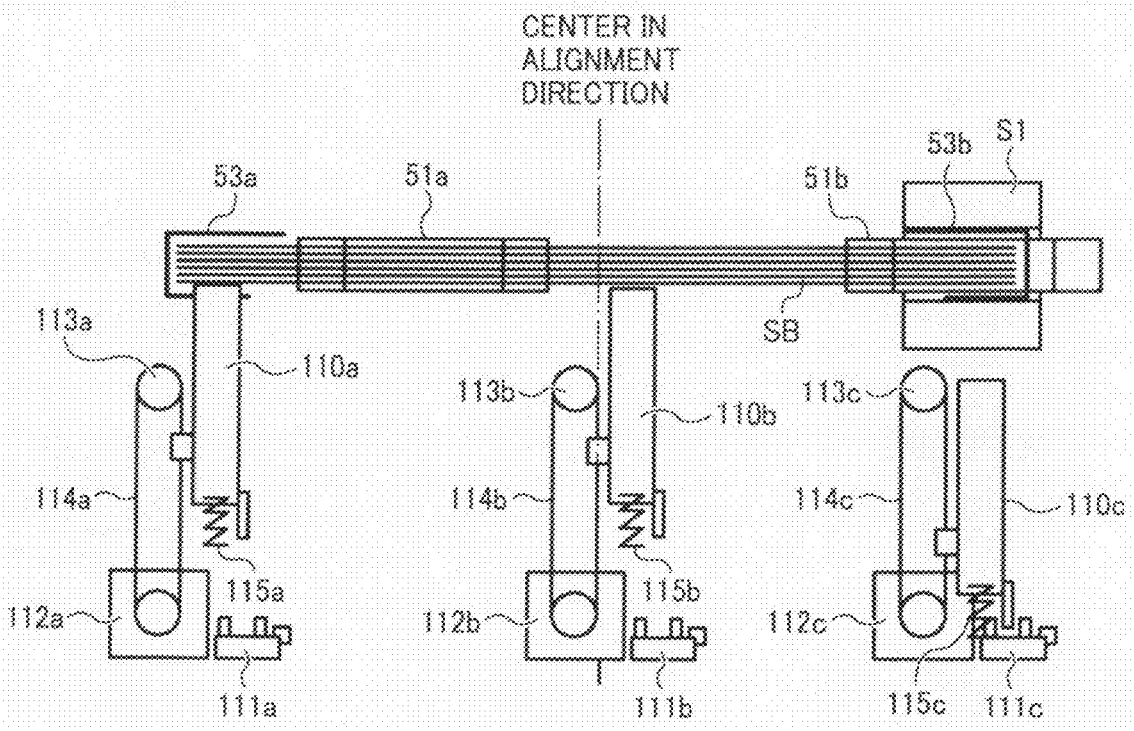
FIG. 7 is a schematic diagram of the sheet pressing mechanism of the staple tray viewed from the sheet-stacked surface for explaining a stand-by position of the stapler in a back-side binding mode.

FIGS. 5, 6, and 7 show a positional relation between the trailing-end-portion pressing levers 110*a*, 110*b*, and 110*c* and a stand-by position of the edge binding stapler S1 in each of binding modes. The stand-by position of the edge binding stapler S1 differs in each of the binding modes. A position of the edge binding stapler S1 shown in FIG. 5 is the stand-by position of the edge binding stapler S1 in a front-side edge binding mode. A position of the edge binding stapler S1 shown in FIG. 6 is the stand-by position of the edge binding stapler S1 in a two-point binding mode. A position of the edge binding stapler S1 shown in FIG. 7 is the stand-by position of the edge binding stapler S1 in a back-side edge binding mode. When the edge binding stapler S1 is located at each of the stand-by positions, if any of the trailing-end-portion pressing levers 110*a*, 110*b*, and 110*c* is activated, the trailing-end-portion pressing lever needs to prevent an interference with the edge binding stapler S1. In the front-side edge binding mode, as shown in FIG. 5, the trailing-end-portion pressing levers 110*b* and 110*c* are activated. In the two-point binding mode, as shown in FIG. 6, the trailing-end-portion pressing levers 110*a*, 110*b*, and 110*c* are activated. In the back-side edge binding mode, as shown in FIG. 7, the trailing-end-portion pressing levers 110*a* and 110*b* are activated. An activation timing of each of the trailing-end-portion pressing levers 110*a*, 110*b*, and 110*c* in each of the binding modes is set up to within a time from when a discharged sheet is stacked in the other in the trailing-end fence 51 and aligned in the sheet width direction by the jogger fence 53 to when a subsequent sheet is aligned by the return roller 12.

In this manner, after a sheet or a stack of sheets conveyed into the staple tray F through the conveying path D has been aligned in both the longitudinal direction and the lateral direction, the trailing-end-portion pressing lever 110 as a pressing unit moves toward the staple tray F to press near a trailing end portion of the sheet or the stack of sheets, and thereby preventing an uplift behavior of the sheet or the stack of sheets and ensuring a conveying path for an entry of a subsequent sheet or a subsequent stack of sheets. At this time, in the present embodiment, a travel distance of the trailing-end-portion pressing lever 110 is changed depending on the number of sheets stacked in the sheet-stacked surface of the staple tray F. For example, when a hundred sheets are stacked in the sheet-stacked surface of the staple tray F, the trailing-end-portion pressing lever 110 stops moving at a position 5 millimeters (mm) away from the sheet-stacked surface of the staple tray F. In this manner, a travel distance of the trailing-end-portion pressing lever 110 is changed depending on the number or a thickness of sheets stacked in the sheet-stacked surface of the staple tray F, so that a pressing force of the trailing-end-portion pressing lever 110 to be applied to the stack of sheets is controlled to be constant. Therefore, an uplift behavior of the sheets can be prevented properly. Incidentally, the number of sheets is determined based on a count value tallied up by the image forming apparatus PR, and the thickness of the stack of sheets is determined based on a thickness of one sheet. If a thin sheet or a thick sheet is selected by a user via an operation panel of the image forming apparatus PR, a thickness of a stack of sheets is determined (calculated) based on an average thickness of typical thin sheets or typical thick sheets. When the user does not specify a type of sheet, a thickness of a stack of sheets is determined based on an average thickness of plain sheets.

Incidentally, the trailing-end-portion pressing lever 110 is configured to stop moving so to meet a condition of "N>M" when a distance between a pressing surface of the trailing-end-portion pressing lever 110 and the sheet-stacked surface of the staple tray F is denoted by "M" and a distance between an outer circumferential surface of the brush roller, which is located on the upstream of the staple tray F, and the sheet-stacked surface of the staple tray F is denoted by "N".

Figure 8:
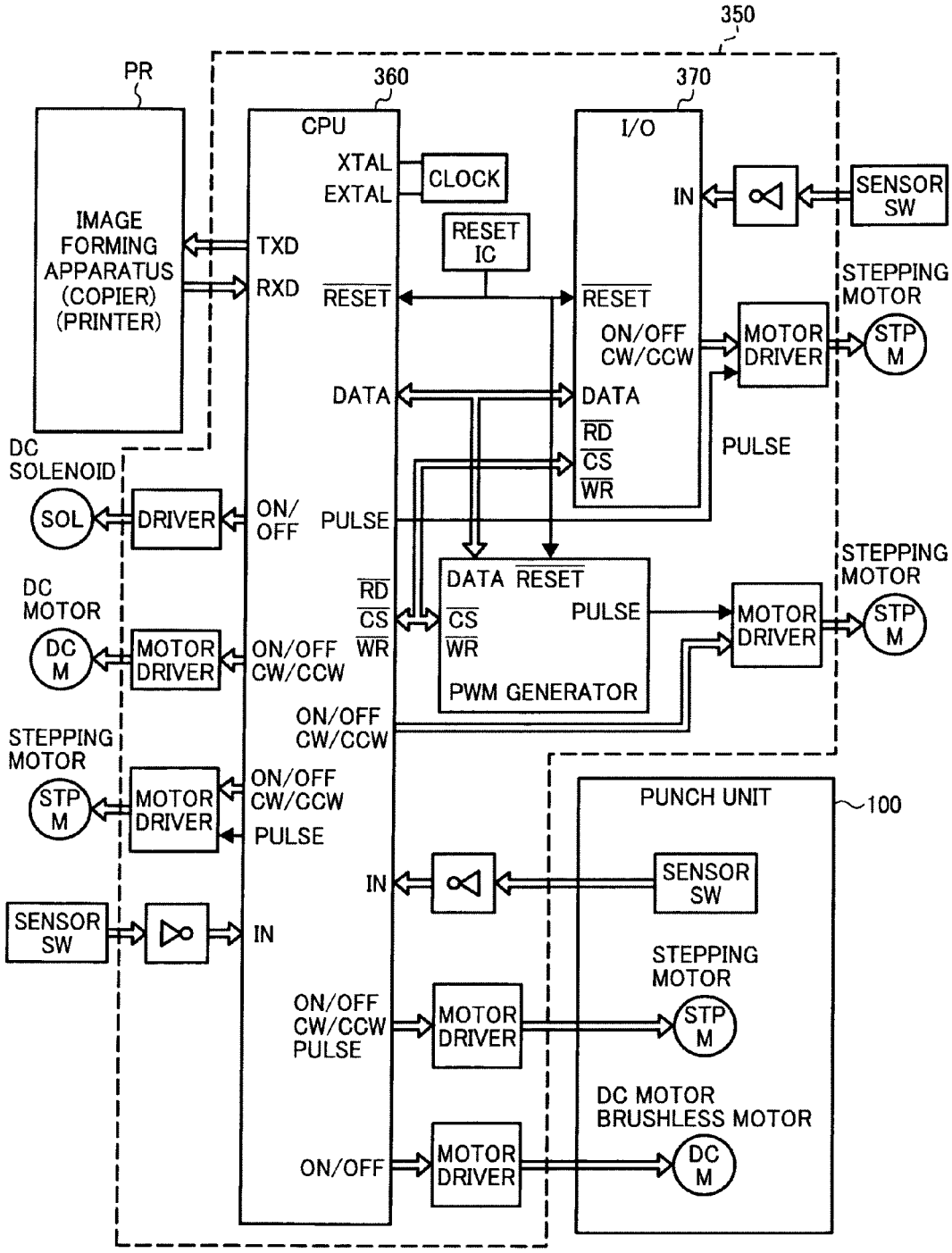
FIG. 8 is a block diagram of a control system configuration of the entire system according to the present embodiment.

FIG. 8 is a block diagram of a control system configuration of the entire system according to the present embodiment. A control unit 350 of the sheet post-processing apparatus PD is a microcomputer including a CPU 360, an input/output (I/O) interface 370, and the like. A signal from each of switches of a control panel (not shown) included in a main body of the image forming apparatus PR and each of sensors such as the sheet-face detecting sensor is input to the CPU 360 via the I/O interface 370. The CPU 360 controls whether to activate each of drive mechanisms based on an input signal. Specifically, the CPU 360 reads a program code stored in a read-only memory (ROM) (not shown), and expands a program indicated in the program code in a random access memory (RAM) (not shown) as a working area. Namely, the CPU 360 activates the corresponding drive mechanism by the execution of the program.

In the present embodiment, after each of sheets corresponding to the number of sheets to be bound is aligned and conveyed into the staple tray F as described above, the trailing-end-portion pressing lever 110 is moved from a sheet-stack pressing position directly to a supporting position where the trailing-end-portion pressing lever 110 supports to discharge the stack of sheets. At this time, the trailing-end-portion pressing lever 110 is controlled to move so as to keep a constant distance from a top-sheet face of the stack of sheets on the sheet-stacked surface of the staple tray F regardless of the number of sheets to be bound, and also controlled to cause the stack of sheets not to come in contact with the outer circumferential surface of the staple discharge roller (the brush roller) 11 located on the upstream of the staple tray F. Therefore, the stack of sheets can be prevented from a buckling distortion occurring when the stack of sheets is discharged. Consequently, it is possible to improve the productivity. In a case of a two-point binding mode, after binding the stack of sheets at the first binding point, the edge-binding stapler S1 is moved to a position corresponding to the second binding point of the stack of sheets. Therefore, in this case, after the first-point binding process, the trailing-end-portion pressing lever 110 is once retracted to the home position. And then, after the edge-binding stapler S1 has been moved to the position corresponding to the second binding point, the trailing-end-portion pressing lever 110 is moved from the home position to the supporting position.

Figure 9:
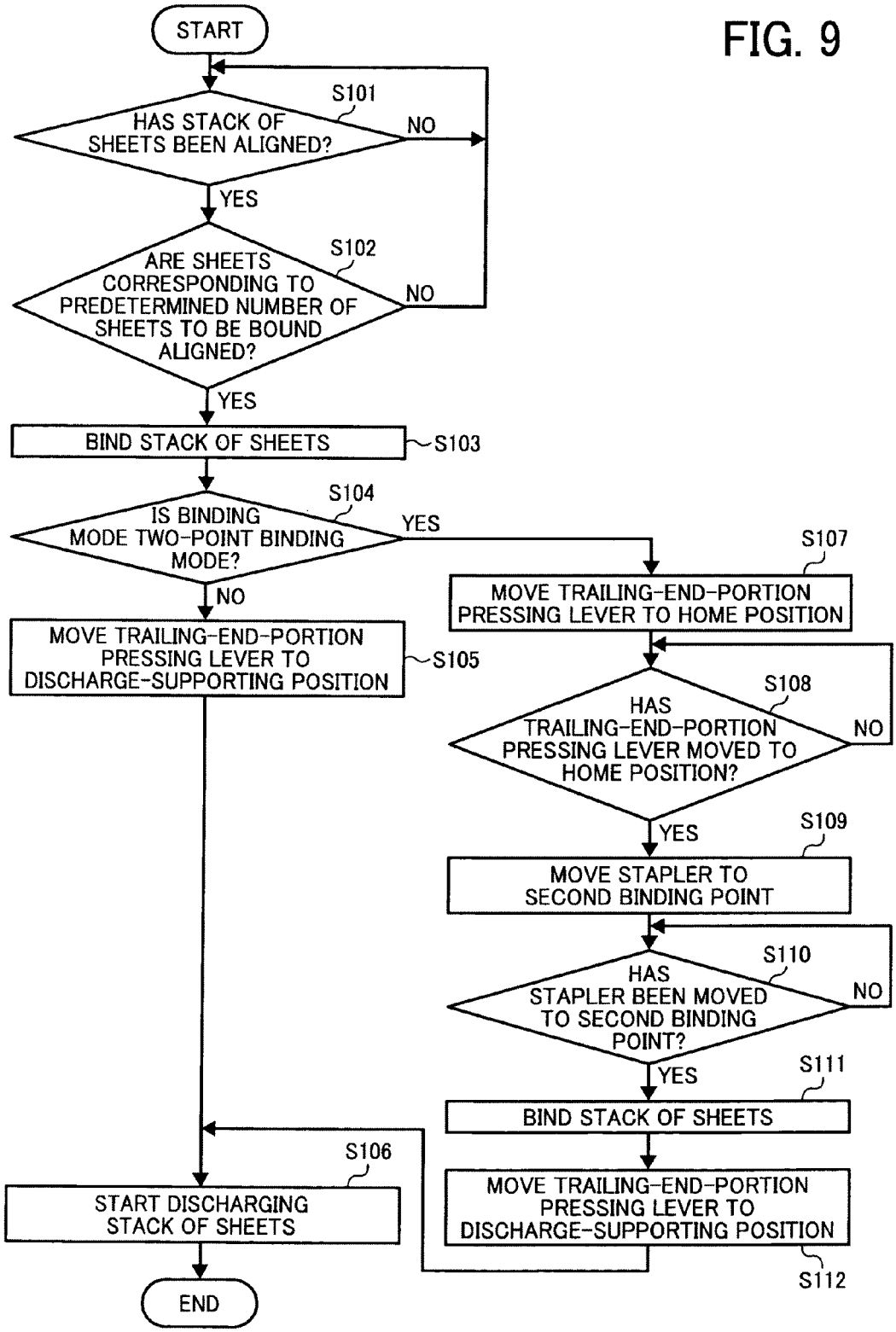
FIG. 9 is a flowchart of operational procedures of the sheet pressing mechanism according to the present embodiment.

Subsequently, a sheet pressing mechanism according to the present embodiment is explained in detail below. FIG. 9 is a flowchart of operational procedures of the sheet pressing mechanism.

Upon completion of the alignment of a stack of sheets (Step S101), whether the sheets corresponding to the predetermined number of sheets to be bound are aligned is checked (Step S102). When the sheets corresponding to the predetermined number of sheets to be bound have been aligned (YES at Step S102), the stapler S1 binds the stack of sheets (Step S103). Then, whether a binding mode is the two-point binding mode is checked (Step S104). When the binding mode is not the two-point binding mode (NO at Step S104), the trailing-end-portion pressing lever 110 is moved to the supporting position (Step S105.), and the stack of sheets is discharged while being supported by the trailing-end-portion pressing lever 110 (Step S106).

On the other hand, when the binding mode is the two-point binding mode (YES at Step S104), the trailing-end-portion pressing lever 110 is moved to the home position (Step S107). After the trailing-end-portion pressing lever 110 has been moved to the home position (Step S108), the stapler S1 is moved to the position corresponding to the second binding point of the stack of sheets (Step S109). After the stapler S1 has been moved to the position corresponding to the second binding point (Step S110), the stack of sheets is bound at the second binding point (Step S111). After that, the trailing-end-portion pressing lever 110 is moved to the supporting position (Step S112), and the stack of sheets is discharged while being supported by the trailing-end-portion pressing lever 110 (Step S106).

Figure 10:
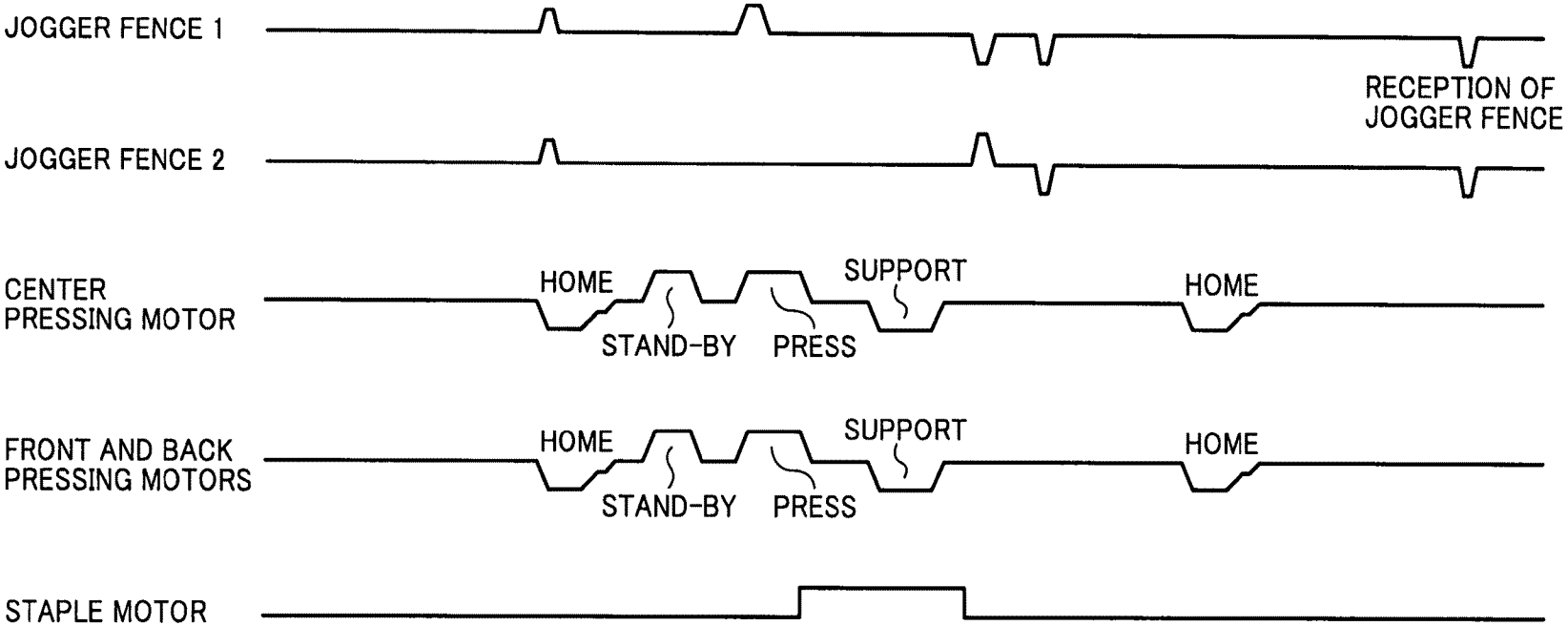
FIG. 10 is a timing chart of an operation of a pressing lever in a one-point binding mode.
Figure 11:
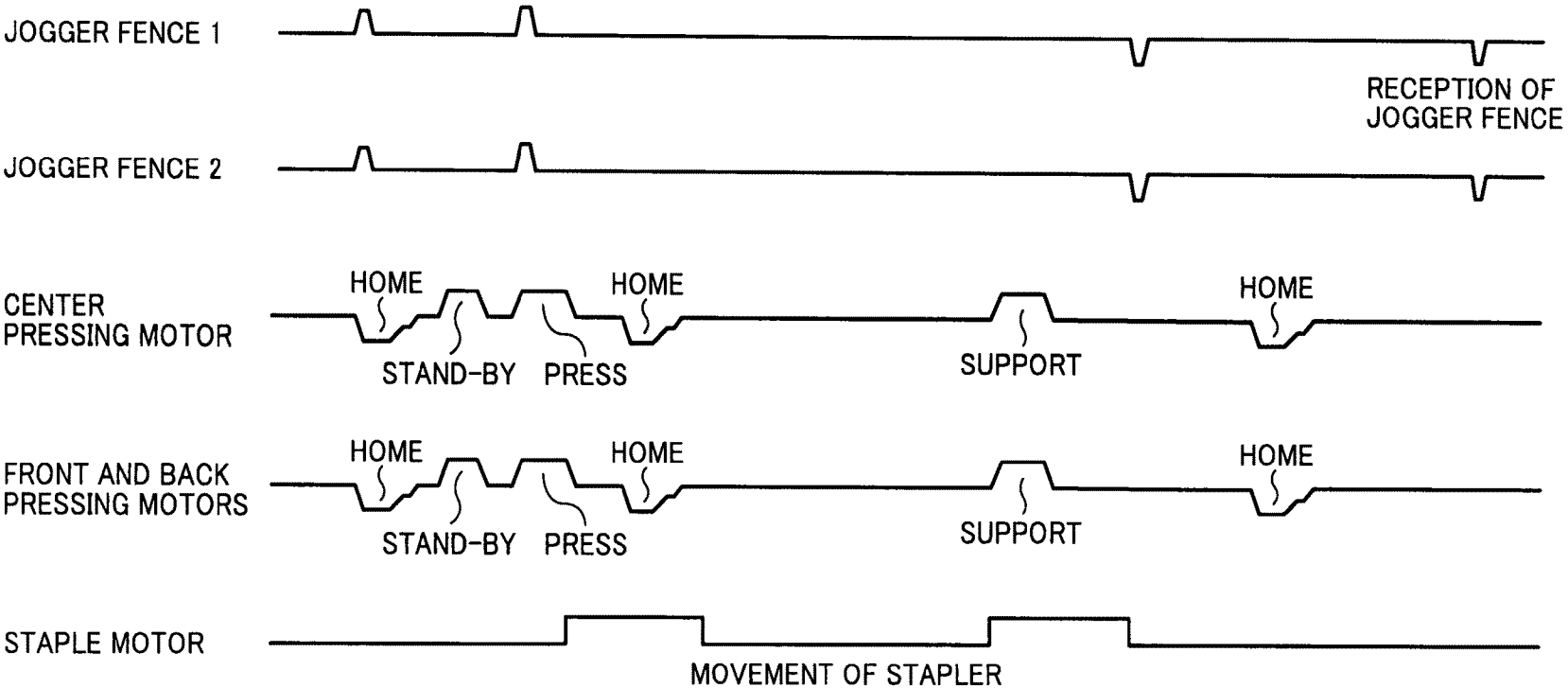
FIG. 11 is a timing chart of an operation of the pressing lever in the two-point binding mode.

FIG. 10 is a timing chart of an operation of the trailing-end-portion pressing lever 110 in a one-point binding mode. FIG. 11 is a timing chart of an operation of the trailing-end-portion pressing lever 110 in the two-point binding mode. In the one-point binding mode, with reference to a jogger fence 2 located on the side of a binding point, a jogger fence 1 pushes a stack of sheets thereby aligning the stack of sheets. After that, in a state where a trailing end portion of the stack of sheets is pressed, a staple motor is driven, and the stack of sheets is stapled. During this operation, the trailing-end-portion pressing lever motors 112*a*, 112*b*, and 112*c* respectively drive the trailing-end-portion pressing levers 110*a*, 110*b*, and 110*c* to move to a position (the supporting position) away from a top-sheet face of the stack of sheets for a predetermined distance so as to meet a condition of "N>M" when a distance between a pressing surface of each of the trailing-end-portion pressing levers 110*a*, 110*b*, and 110*c* and the sheet-stacked surface of the staple tray F is denoted by "M" and a distance between the outer circumferential surface of the brush roller 11, which is located on the upstream of the staple tray F, and the sheet-stacked surface of the staple tray F is denoted by "N". Upon completion of the stapling process, the trailing-end-portion pressing levers 110*a*, 110*b*, and 110*c* discharge the stack of sheets. After pressing the trailing end portion of the stack of sheets, the trailing-end-portion pressing levers 110*a*, 110*b*, and 110*c* are moved from the pressing position to the supporting position.

In the two-point binding mode, with reference to the alignment center, the jogger fences 1 and 2 center-align the stack of sheets. After that, in a state where the trailing end portion of the stack of sheets is pressed by the trailing-end-portion pressing levers 110*a*, 110*b*, and 110*c*, the stack of sheets is stapled at the first binding point. During this operation, the trailing-end-portion pressing levers 110*a*, 110*b*, and 110*c* are retracted to the home position, and the stapler S1 is moved to a position corresponding to the second binding point of the stack of sheets. Upon completion of the first binding process, i.e., when the stack of sheets is stapled at the second binding point, the trailing-end-portion pressing levers 110*a*, 110*b*, and 110*c* are moved from the home position to the supporting position. Upon completion of the second binding process, the trailing-end-portion pressing levers 110*a*, 110*b*, and 110*c* discharge the stack of sheets.

In this manner, in the present embodiment, a distance between a top-sheet face of a stack of sheets stacked in the sheet-stacked surface of the staple tray F and the trailing-end-portion pressing lever 110 is controlled to keep constant. Therefore, the stack of sheets can be prevented from a buckling distortion occurring when the stack of sheets is discharged regardless of the number of sheets, and thus it is possible to provide a highly reliable apparatus. Moreover, a timing when the trailing-end-portion pressing lever 110 presses a stack of sheets is changed depending on whether the one-point binding mode or the two-point binding mode, so that the timing can be optimally controlled depending on the binding mode. Therefore, it is possible to shorten a staple-processing time from when the stack of sheets is aligned to when the stapled stack of sheets is discharged. Consequently, it is possible to improve the productivity.

According to an aspect of the present invention, when a stack of sheets is discharged by the discharging unit, a distance between a top-sheet face of the stack of sheets stacked in the sheet-stacked surface of the staple tray and the pressing unit is controlled to keep constant. Therefore, the stack of sheets can be prevented from a buckling distortion occurring when the stack of sheets is discharged, and thus the productivity can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing device comprising:

a tray to stack a conveyed sheet;

a pressing unit to press a vicinity of a trailing edge of a stack of sheets stacked in the tray;

an aligning unit to align the stack of sheets stacked in the tray;

a stapling unit to bind the stack of sheets aligned by the aligning unit;

a discharging unit to discharge the stack of sheets bound by the stapling unit; and a control unit to control the pressing unit to keep a constant distance from a surface of a top sheet of the stack of sheets when the discharging unit discharges the stack of sheets, wherein a start position and a start timing of the pressing unit when moving to a position to keep the constant distance vary depending on binding patterns.

2. The sheet processing device according to claim 1, wherein the constant distance is determined to satisfy a condition N>M, where N is distance between an outer circumferential surface of a brush roller that is located on an upstream side of the tray and a surface of the tray on which the stack of sheets is stacked and M is distance between a pressing surface of the pressing unit and the surface of the tray.

3. The sheet processing device according to claim 1, wherein the start position is a pressing position of the pressing unit.

4. The sheet processing device according to claim 3, wherein the start timing to move from the pressing position is when a pressing of the stack of sheets conveyed to the tray is completed.

5. The sheet processing device according to claim 1, wherein the start position is a home position of the pressing unit.

6. The sheet processing device according to claim 5, wherein the start timing to move from the home position is after a movement of the stapling unit is completed.

7. The sheet processing device according to claim 1, wherein the binding patterns include a one-point binding pattern and a two-point binding pattern.

8. An image forming apparatus comprising a sheet processing device that includes a tray to stack a conveyed sheet;

a pressing unit to press a vicinity of a trailing edge of a stack of sheets stacked in the tray;

an aligning unit to align the stack of sheets stacked in the tray;

a stapling unit to bind the stack of sheets aligned by the aligning unit;

a discharging unit to discharge the stack of sheets bound by the stapling unit; and a control unit to control the pressing unit to keep a constant distance from a surface of a top sheet of the stack of sheets when the discharging unit discharges the stack of sheets, wherein a start position and a start timing of the pressing unit when moving to a position to keep the constant distance vary depending on binding patterns.

* * * * *